United States Patent [19]

Sakamoto

[11] 4,321,802

[45] Mar. 30, 1982

[54] ICE AND WATER-MAKING REFRIGERATION APPARATUS

[75] Inventor: Shigetoshi Sakamoto, Toyoake, Japan

[73] Assignee: Hoshizaki Electric Co., Ltd., Toyoake, Japan

[21] Appl. No.: 165,402

[22] Filed: Jul. 2, 1980

[30] Foreign Application Priority Data

Jul. 5, 1979 [JP] Japan ..... 54-84443

[51] Int. Cl.[3] ..... F25B 25/00

[52] U.S. Cl. ..... 62/330; 62/59; 62/332; 62/347

[58] Field of Search ..... 62/59, 330, 332, 347, 62/344

[56] References Cited

U.S. PATENT DOCUMENTS

| | | | |
|---|---|---|---|
| 2,449,132 | 9/1948 | Lucia | 62/344 X |
| 2,496,304 | 2/1950 | Muffly | 62/59 X |
| 2,572,508 | 10/1951 | Muffly | 62/330 X |
| 2,709,343 | 5/1955 | Muffly | 62/330 X |
| 3,541,808 | 11/1970 | Materese | 62/332 X |
| 3,961,496 | 6/1976 | Ku | 62/332 X |
| 4,249,388 | 2/1981 | Burns | 62/330 X |

*Primary Examiner*—William E. Tapolcai, Jr.

*Attorney, Agent, or Firm*—Wenderoth, Lind & Ponack

[57] ABSTRACT

A refrigeration apparatus which produces ice and pure water obtained by thawing the ice, and having a refrigeration compartment for foods and beverages which is cooled indirectly by the low temperature of the ice and pure water. Ice produced by an ice-making unit is allowed to fall on the refrigeration compartment which is partially surrounded by a storage tank for collecting pure water obtained when the fallen ice is thawed by heat exchange with the refrigeration compartment. Foods cooled indirectly by the ice and cold pure water are prevented from drying and excessive cooling.

4 Claims, 3 Drawing Figures

ICE AND WATER-MAKING REFRIGERATION APPARATUS

BACKGROUND OF THE INVENTION

The present invention relates to a refrigerator, and more particularly to a refrigerator in which the evaporator or cooling unit is disposed outside, rather than inside, the refrigeration compartment.

A method and apparatus for the production of substantially purified water through the removal of impurities from raw water by a freezing process is known in the art as disclosed in, for example, Japanese Published Unexamined Patent Application No. 52-148477 filed by the present Applicant. The apparatus described in the specification of the above Application includes an ice-making unit in which ice is produced by supplying an ice-making surface with raw water circulated from a water tank for storing water used in the ice-making process, a thawing unit in which at least a portion of the manufactured ice is thawed to produce pure water, and a storage portion which stores the pure water and which allows the pure water to be taken out when necessary.

The above apparatus effects the thawing of ice by heating the ice with an electric heater or by extending the refrigeration piping of the ice-making unit to the thawing unit and supplying the latter with a hot gas through use of a compressor, thereby applying heat to the ice. However, such thawing methods inevitably consume a large quantity of electric power, either for energizing the electric heater or for driving the compressor.

A further disadvantage is encountered in the ice-making unit which circulates the raw water from the water tank and feeds the raw water to the ice-making surface to produce the ice, as described above. Specifically, residual water remains in the water tank at the conclusion of each ice-making cycle which starts with the initial supply of raw water to the ice-making surface and which ends with the formation of a prescribed quantity of ice on the ice-making surface, and this residual water must be discarded since it contains a comparatively high concentration of impurities which are concentrated during each such cycle. However, since the residual water has repeatedly passed the ice-making surface cooled by the evaporator, the temperature of the water is fairly low, i.e., on the order of almost 0° C. The quantity of this residual water discarded during one ice-making cycle differs depending upon the type of pure water making apparatus, but it may be more than half, or perhaps almost equal to, the amount of ice produced by a single ice-making cycle. As this is a large quantity of water, a considerably large amount of potential heat is wastefully discarded along with the residual water.

Accordingly, it is a general object of the present invention to avoid the shortcomings encountered in the prior art as described above.

A specific object of the present invention is to provide a refrigeration apparatus which makes it possible to cool a refrigeration compartment for foods and beverages not by the direct use of an evaporator but by employing the low temperature of ice and pure water not hitherto effectively utilized in the conventional pure water-making apparatus, which refrigeration apparatus also has the capability of supplying pure water.

SUMMARY OF THE INVENTION

To accomplish the foregoing objects the apparatus of the present invention includes an ice-making unit for producing ice by supplying an ice-making surface with raw water circulated from a water tank for storing water used in the ice-making process, a refrigeration portion constructed of plate members having a comparatively high thermal conductivity and arranged to form a refrigeration compartment whose front side is open, the refrigeration portion being disposed below the ice-making surface, and a pure water storage tank having a bottom and constructed of plate members surrounding the back and both side walls of the refrigeration portion and spaced apart therefrom by a prescribed distance, the ice-making unit, refrigeration portion and pure water storage tank being disposed in a bottomed casing having an openable and closable door provided to confront the open front side of the refrigeration compartment. In accordance with this arrangement, ice from the ice-making unit falls on the top surface of the refrigeration compartment which is disposed below the ice-making unit, whereupon the heat exchanging action between the ice and the refrigeration compartment thaws the ice and cools the refrigeration compartment, while the pure water which results from the thawing of the ice flows into and is collected by the pure water storage tank surrounding the refrigerant compartment. Accordingly, since the ice is thawed by the heat from the refrigeration compartment and the foods accommodated therein, no electric power is consumed for an electric heater or for the supply of a hot gas, and it is possible to simultaneously thaw the ice and refrigerate the foods without causing the excessive cooling or drying of foods. Moreover, since the pure water storage tank surrounds the refrigeration compartment, the latter can be cooled with greater effectiveness by means of the low temperature pure water.

Other objects, aspects and advantages of the present invention will be apparent from the following description considered together with the accompanying drawings.

DESCRIPTION OF THE PREFERRED EMBODIMENTS

Figure 1:
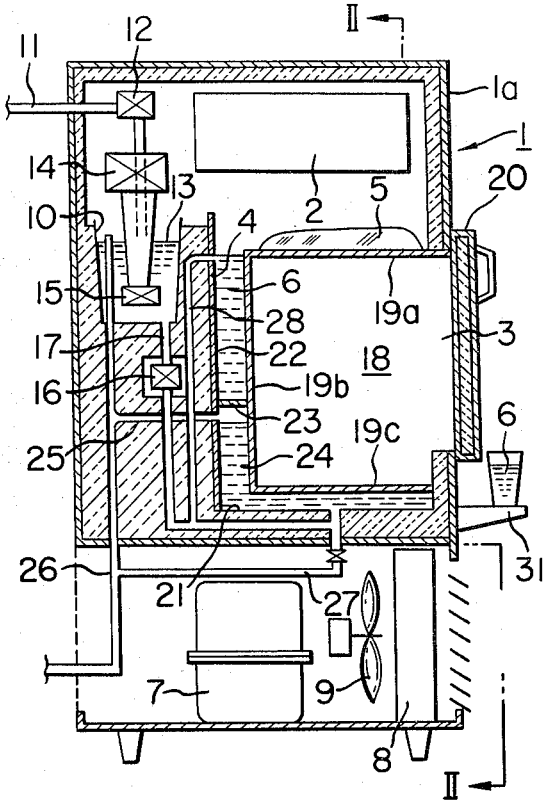
FIG. 1 is a side view, partially in section, showing a first embodiment of a refrigeration apparatus according to the present invention.

A first embodiment of the present invention will be described in conjunction with FIGS. 1 and 2, wherein like reference numerals designate the identical or corresponding components.

Figure 2:
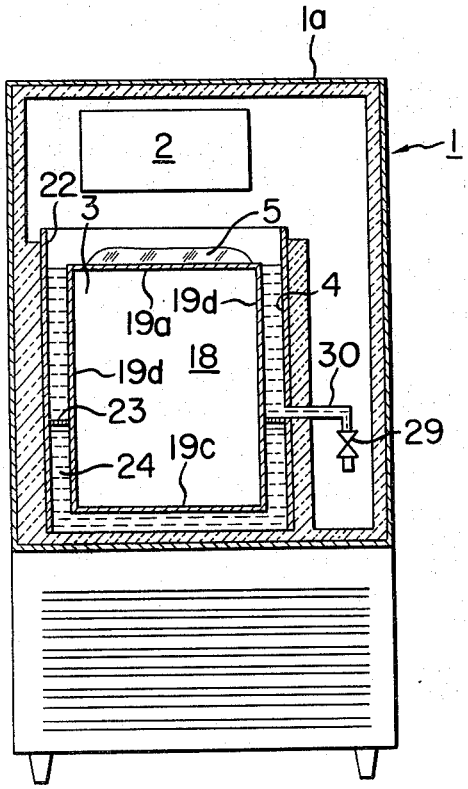
FIG. 2 is a front view of a portion of which is shown in section taken along the line II—II of FIG. 1.

In FIGS. 1 and 2, a refrigeration apparatus 1 has a substantially box-shaped casing 1*a* equipped with an ice-making unit 2, a refrigeration portion 3 disposed below the ice-making unit 2 to refrigerate foods and beverages, and a substantially U-shaped pure water storage tank 4 surrounding the refrigeration portion 3. Ice 5 produced by the ice-making unit 2, in a manner which will be described later, falls on top of the refrigeration portion 3 and at least a portion of the ice is thawed by the heat from the refrigeration portion. The resulting pure water is collected in the pure water storage tank 4.

The ice-making unit 2 may be of the conventional variety having an ice-making surface which is not shown, and an evaporator, which is not shown, for cooling the ice-making surface. In the illustrated embodiment the ice-making unit 2 is constructed to produce sheet ice 5.

A suitable coolant obtained from the evaporator of the ice-making unit 2 is circulated to cool the ice-making surface mounted on the evaporator, and is returned to the latter through a compressor 7, a condenser 8 and expansion means which is not shown, these latter units being arranged in the refrigeration piping which is not illustrated. Reference numeral 9 denotes a cooling fan for the condenser 8.

Disposed at a comparatively upper portion of the casing 1*a* and housed therein is a water tank 10 which stores the water for the ice-making process. Raw water 13 is fed into the water tank 10, prior to the start of the ice-making cycle, from an external water conduit controlled by a solenoid valve 12. The raw water 13 is sent through a pipe, which is not shown, by a pump 15 driven by a driving motor 14 and is delivered to the ice-making surface which is cooled as described above. Raw water which has not been frozen by the ice-making surface is returned again to the water tank 10 and is recirculated for supply back to the ice-making surface.

At the completion of a single ice-making cycle that produces a prescribed quantity of ice, residual water which remains from the ice-making operation and which contains impurities and organic substances is discharged to a point outside the water tank 10 through a discharge pipe 25 by opening a solenoid valve 16. Since the residual water has repeatedly passed the ice-making surface during the ice-making cycles, the water is cooled to a fairly low temperature of almost 0° C. The quantity of this water differs depending upon the type of apparatus used to produce the pure water, but it may be large or equivalent to more than half, or perhaps almost equal to, the amount of ice produced by a single ice-making cycle.

The refrigeration portion 3 is constructed of a material, such as stainless steel plate members 19, having a comparatively high thermal conductivity and arranged to form a refrigeration compartment 18 whose front side is open. The casing 1*a* includes a door 20 which is attached to confront and hence close the open front side of the refrigeration compartment 18. The latter has a top 19*a*, a back wall 19*b*, a bottom 19*c* and two side walls 19*d*. The top 19*a* is positioned so as to receive the ice 5 which falls from the ice-making surface, and the bottom 19*c* is spaced apart from the bottom 21 of the casing 1*a* by a prescribed distance for a purpose which will be subsequently described. Thus, since an evaporator or cooler is not installed in the refrigeration compartment 18, it is possible to suitably refrigerate such foods as lettuce, celery and endive that are damaged by drying. In addition, such beverages as beer and wine can be refrigerated at an optimum temperature since the interor of the refrigeration compartment is never cooled to an excessive degree.

To cool the refrigeration compartment 18 with even greater effectiveness the pure water storage tank 4, having the U-shaped configuration as formed by a plate member 22, is arranged to surround the back wall 19*b* and both side walls 19*d* of the refrigeration compartment 18. The plate members 19 and 22 are spaced apart by a prescribed distance, and it is this spacing that determines the capacity of the tank. The bottom of the tank is designated as 23 and is provided approximately midway along the height of the refrigeration compartment or slightly below this position. The location of the tank bottom 23 also determines the capacity both of the pure water storage tank 4 and a residual water accumulation space 24.

The plate member 22, in order to form the residual water accumulation space 24 below the pure water storage tank 4, is extended down to the bottom 21 of the casing 1*a* and is sealed thereat. Since the bottom 19*c* of the refrigeration compartment 18 is spaced apart from the bottom 21 of the casing 1*a*, the residual water accumulation space 24 surrounds approximately the lower half of the refrigeration compartment 18, with the exception of its front side. The residual water discharge pipe 17 from the water tank 10 is connected with the residual water accumulation space 24 at the lower portion thereof to introduce the residual water into the space 24. A residual water overflow pipe 25 and an overflow pipe 26 which is provided on the water tank 10 are arranged to combine so as to discharge both the residual water and raw water to a point outside the refrigeration apparatus. A residual water drainage pipe is designated as 27.

An overflow pipe 28 provided on the pure water storage tank 4 combines with the residual water discharge pipe 17 and is arranged to allow more effective utilization of the low-temperature pure water. In addition, the pure water storage tank 4 is provided at its lower portion with a pure water discharge pipe 30 having a discharge valve 29 which is illustrated in FIG. 2. Opening the discharge valve 29 supplies the pure water in a suitable manner. Reference numeral 31 denotes a tray which is mounted on the casing 1*a* in order to support a cup or glass into which the pure water 6 is poured.

Figure 3:
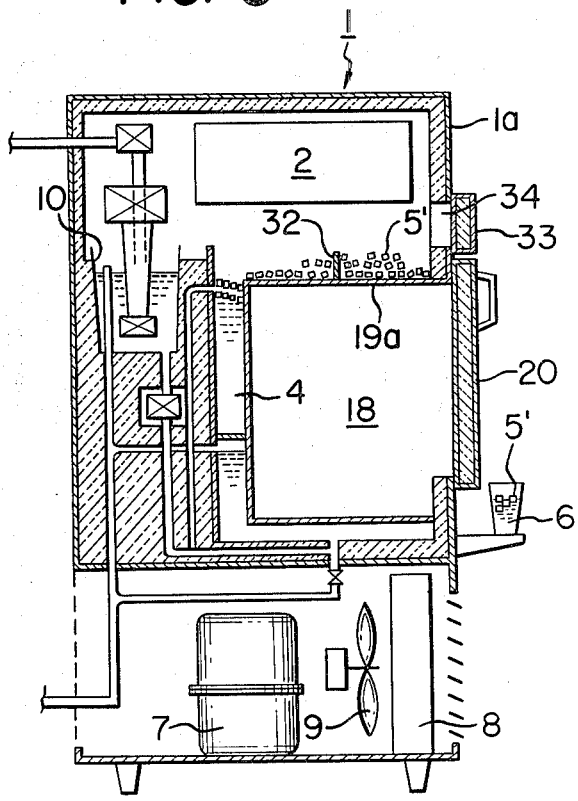
FIG. 3 is a side view, partially in section, showing a second embodiment of a refrigeration apparatus according to the present invention.

A second embodiment of the present invention is shown in FIG. 3, wherein like reference numerals designate the identical or corresponding components as those in FIGS. 1 and 2.

In the present embodiment the ice-making unit 2 produces ice cubes 5' directly or first produces ice sheet that is then converted into ice cubes 5'. The top 19*a* of the refrigeration compartment is provided with a partition plate 32 which has a suitable height and which traverses the top 19*a* in the direction of its width, the partition plate serving to divide into two groups the ice cubes 5' which have fallen from the ice-making unit 2. The ice cubes 5' in the group shown on the right side in the drawing can be taken out of an opening when desired by opening a small door 33 provided on the 1*a*. The apparatus of this embodiment is otherwise identical with that of the first embodiment.

The refrigeration apparatus of the present invention having the construction described above is arranged such that the ice produced by each ice-making cycle falls on the top 19 of the refrigeration compartment 18 to cool the compartment while being thawed by the heat released thereby, the resulting pure water, having a temperature close to 0° C., surrounding the sides and back of the refrigeration compartment. The refrigeration apparatus therefore makes it possible to cool a refrigeration compartment for foods and beverages not by the direct use of an evaporator but by employing the low temperature of ice and pure water not hitherto effectively utilized in the conventional pure water-making systems. The apparatus also allows pure water to be supplied. In addition, it is possible to effectively cool the refrigeration compartment without wasting low-temperature energy because the large quantity of residual water at a temperature close to 0° C., which water is discarded during each ice-making cycle in the prior art, is accumulated around the lower half of the refrigeration compartment, specifically the bottom, back and both side walls thereof. The cooling of the refrigeration compartment can be carried out even more effectively if an overflow pipe provided on the pure water storage tank is connected to the residual water accumulation space.

As many apparently widely different embodiments of this invention may be made without departing from the spirit and scope thereof, it is to be understood that the invention is not limited to the specific embodiments thereof except as defined in the appended claims.

What is claimed is:

1. A refrigeration apparatus comprising an ice-making unit for producing ice by supplying an ice-making surface with raw water circulated from a water tank for storing water used in the ice-making process;

a refrigeration portion constructed of plate members having a comparatively high thermal conductivity and arranged to form a refrigeration compartment whose front side is open, said refrigeration portion being disposed below the ice-making surface;

a pure water storage tank having a bottom and constructed of plate members surrounding back and side walls of said refrigeration portion and spaced apart therefrom by a prescribed distance; and a casing provided with a bottom for accommodating said ice-making unit, said refrigeration portion and said pure water storage tank, said casing having an openable and closable door mounted to confront the open front side of said refrigeration compartment;

said ice-making unit producing ice which is allowed to fall onto the top of said refrigeration portion so that heat exchange between the fallen ice and said refrigeration portion causes at least a portion of the ice to thaw and cools said refrigeration compartment, the pure water which results from the thawing of the ice being permitted to flow into the pure water storage tank and being collected in said pure water storage tank while simultaneously cooling said refrigeration compartment.

2. A refrigeration apparatus according to claim 1, in which said casing is provided with an openable and closable door adjacent said ice-making unit to permit the removal of the ice which has fallen on said refrigeration portion from said ice-making surface.

3. A refrigeration apparatus according to claim 1, in which said water tank contains residual water at the completion of an ice-making cycle of said ice-making unit, which residual water is discharged every ice-making cycle into a space arranged below said pure water storage tank and surrounding the back, side walls and bottom of said refrigeration portion.

4. A refrigeration apparatus according to claim 3, in which said pure water storage tank includes an overflow pipe evacuating into said residual water accumulation space.

* * * * *